US007544282B2

(12) United States Patent
De Vogelaere et al.

(10) Patent No.: US 7,544,282 B2
(45) Date of Patent: Jun. 9, 2009

(54) METHOD FOR FILLING MATERIAL SEPARATIONS ON A SURFACE

(75) Inventors: Marc De Vogelaere, Berlin (DE); Ursus Krüger, Berlin (DE); Daniel Körtvelyessy, Berlin (DE); Ralph Reiche, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 416 days.

(21) Appl. No.: 10/539,939

(22) PCT Filed: Dec. 1, 2003

(86) PCT No.: PCT/DE03/03954

§ 371 (c)(1),
(2), (4) Date: Jun. 17, 2005

(87) PCT Pub. No.: WO2004/057062

PCT Pub. Date: Jul. 8, 2004

(65) Prior Publication Data

US 2006/0070882 A1 Apr. 6, 2006

(30) Foreign Application Priority Data

Dec. 18, 2002 (DE) ..... 102 59 361

(51) Int. Cl.
*C25D 5/02* (2006.01)
*C25D 5/18* (2006.01)

(52) U.S. Cl. ..... 205/115; 205/89; 205/103; 205/104; 205/148; 205/170

(58) Field of Classification Search ..... 205/115, 205/89, 103, 104, 148, 170
See application file for complete search history.

(56) References Cited

U.S. PATENT DOCUMENTS

| | | | | | |
|---|---|---|---|---|---|
| 4,436,591 | A | * | 3/1984 | de Hek | 205/75 |
| 4,895,625 | A | * | 1/1990 | Thoma et al. | 205/109 |
| 5,158,653 | A | * | 10/1992 | Lashmore et al. | 205/103 |
| 5,660,705 | A | | 8/1997 | Michaut | |
| 6,024,861 | A | * | 2/2000 | Takeuchi et al. | 205/729 |
| 6,072,313 | A | | 6/2000 | Li et al. | |
| 7,008,522 | B2 | * | 3/2006 | Boucard et al. | 205/115 |

FOREIGN PATENT DOCUMENTS

| | | | |
|---|---|---|---|
| DE | 3627779 | A1 | 2/1988 |
| DE | 41 11 174 | A1 | 10/1992 |
| DE | 195 48 198 | A1 | 7/1997 |
| EP | 0 622 810 | A1 | 11/1994 |
| EP | 1 241 473 | A1 | 9/2002 |
| GB | 1521130 | | 8/1978 |
| JP | 2170997 | | 7/1990 |
| JP | 2197393 | | 8/1990 |
| WO | WO 03/006710 | A1 * | 1/2003 |

* cited by examiner

*Primary Examiner*—Patrick Ryan
*Assistant Examiner*—William T Leader

(57) ABSTRACT

Disclosed are a method and a device for filling material separations on the surface. In methods known in prior art, which are used for filling material separations, the substrate is often influenced in a negative manner by high processing temperatures and dissimilar additives. The inventive method overcomes said disadvantage, taking place at low temperatures and allowing the material separation to be completely filled without using dissimilar substances.

17 Claims, 3 Drawing Sheets

METHOD FOR FILLING MATERIAL SEPARATIONS ON A SURFACE

CROSS REFERENCE TO RELATED APPLICATION

This application is the US National Stage of International Application No. PCT/DE2003/003954, filed Dec. 1, 2003 and claims the benefit thereof.

The International Application claims the benefits of German Patent application No. 10259361.2 DE filed Dec. 18, 2002, both of the applications are incorporated by reference herein in their entirety.

FIELD OF THE INVENTION

The invention relates to a method and an apparatus for filling material separations in accordance with the preamble of the claims.

BACKGROUND OF THE INVENTION

Material separations at an inner and/or outer surface of a component—for example comprising a substrate or a layer—such as for example cracks, drilled holes or manufacturing-related, operationally induced notches, often have to be closed up again by welding or soldering processes. These methods use high temperatures in the vicinity of the material separation which is to be filled, leading to thermal stresses in the substrate/layer of a component, which can lead to cracks. The material which is used in the welding or soldering processes to fill the material separation often has a considerably reduced mechanical strength compared to the material of the substrate, with the result that the ability of the component to be repaired is limited.

SUMMARY OF THE INVENTION

Therefore, it is an object of the invention to provide a method and an apparatus for filling material separations in which the abovementioned drawbacks are overcome.

The object is achieved by a method and an apparatus in accordance with the claims.

Further advantageous refinements of the method and apparatus according to the invention are listed in the subclaims.

BRIEF DESCRIPTION OF THE DRAWINGS

Exemplary embodiments are shown in the figures, in which.

DETAILED DESCRIPTION OF THE INVENTION

Figure 1:
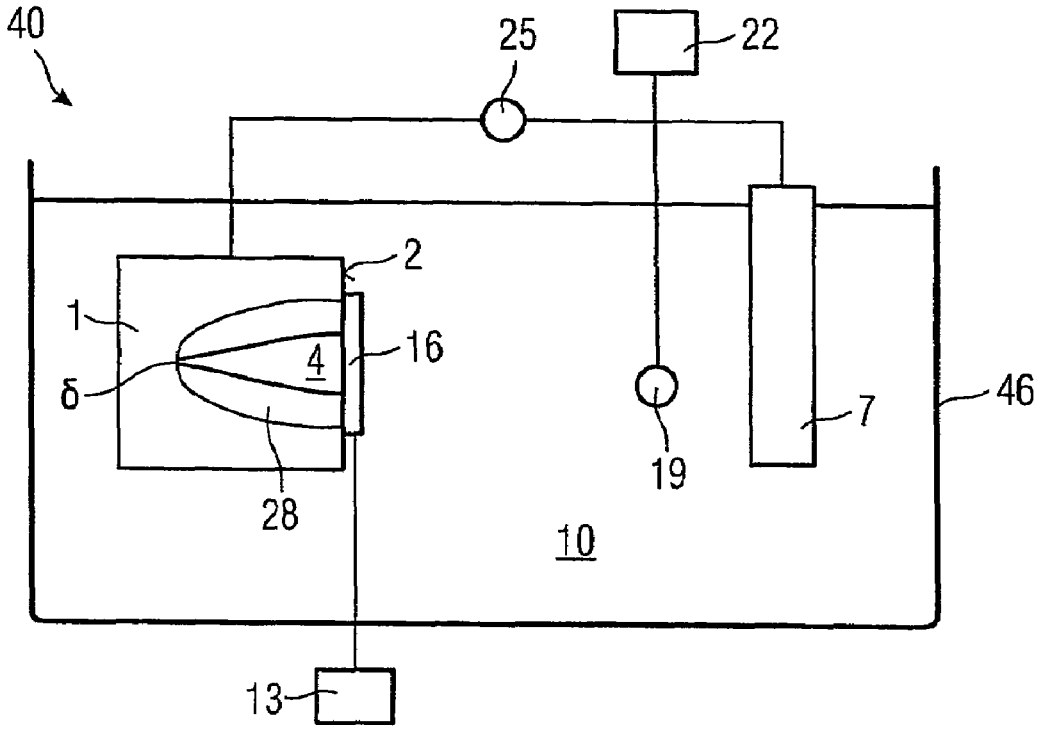
FIG. 1 shows an apparatus which is used to carry out the method according to the invention.

FIG. 1 shows an apparatus 40 according to the invention which is used to carry out the method according to the invention. Material is introduced into a material separation 4 in a substrate 1 or a layer 1 extending from a surface 2 in an electrolytic process at low temperatures, for example lower than 100° C.

The substrate 1 with its material separation 4 is electrically connected to an electrode 7, which together are arranged in an electrolyte 10 which is present in a vessel 46. There is an electric voltage source 25 between the electrode 7 and the substrate 1, so that an electric current can flow.

The electrolyte 10 contains the material which is introduced into the material separation 4. The solution of the electrolyte 10 may include constituents of the composition of the substrate 1 in the form of particles and/or ions.

The process of the method according to the invention can take place at room temperature or low temperatures, which means that prior to use of the method according to the invention the substrate 1 can have a suitable mask (waxes, polymers) applied to it in a simple way at the locations at which coating is not desired, and can thus be protected against being coated.

The use of a flow of current which varies over the course of time makes it possible to effect targeted deposition of the constituents, for example an alloy, from the electrolyte 10 into the material separation 4 of the component 1.

Required materials properties can be set, for example, by a subsequent heat treatment, as is necessary, for example, for nickel-base and cobalt-base superalloys for turbine blades and vanes in order to obtain the desired γ-γ' precipitations or to achieve a phase change or phase adjustment.

The deposition of material of the same or a similar type to the material of the substrate 1, in the form of particles and/or ions, results in a significantly improved strength than with soldering or welding processes, since in the latter cases, constituents which are foreign to the substrate penetrate into the material separation 4 as a result of the soldering or welding additions. This is not the case when using electrolytic deposition.

In this case, material of the substrate 1 or layer 1 or material which has similar properties can be used.

The deposition process in the material separation 4 can optionally be improved by additional ultrasound excitation by means of at least one ultrasound probe 19, which is operated by an ultrasound source 22, in the electrolyte 10. The ultrasound excitation inter alia effects continuous mixing of the electrolyte 10, so that there are no inhomogeneities in the electrolyte 10 and its constituents. Furthermore, porous parts of a layer formed by the filling material are cavitationally removed by the effect of the ultrasound waves.

A further improvement of the method can preferably be achieved by the use of pulsed currents.

Furthermore, the method can be improved by an eddy-current probe 16 being arranged in the region of the material separation 4, for example being placed on top of it, producing a corresponding interaction volume 28 in the substrate 1 around the material separation 4, i.e. the interaction volume 28 is mechanically excited, i.e. generates oscillations in the substrate 1.

The eddy-current probe 16 surrounds, for example, the opening 43 of the material separation 4 at the surface 2 toward the electrolyte 10, but does not cover this opening. The eddy-current probe 16 is operated by a controllable eddy-current generator 13. The depth of penetration δ, i.e. the depth to which the interaction volume 28 extends into the substrate 1 from the surface 2, is given by the following formula:

$$\delta = \frac{503}{\sqrt{f\sigma\mu_r}}$$

in which f is the frequency of the eddy-current, $\sigma$ is the conductivity of the substrate 1 and $\mu_r$ is the permeability constant of the substrate/layer 1.

Therefore, the depth of penetration $\delta$ and the interaction volume 28 can be set by means of the frequency f.

Figure 2:
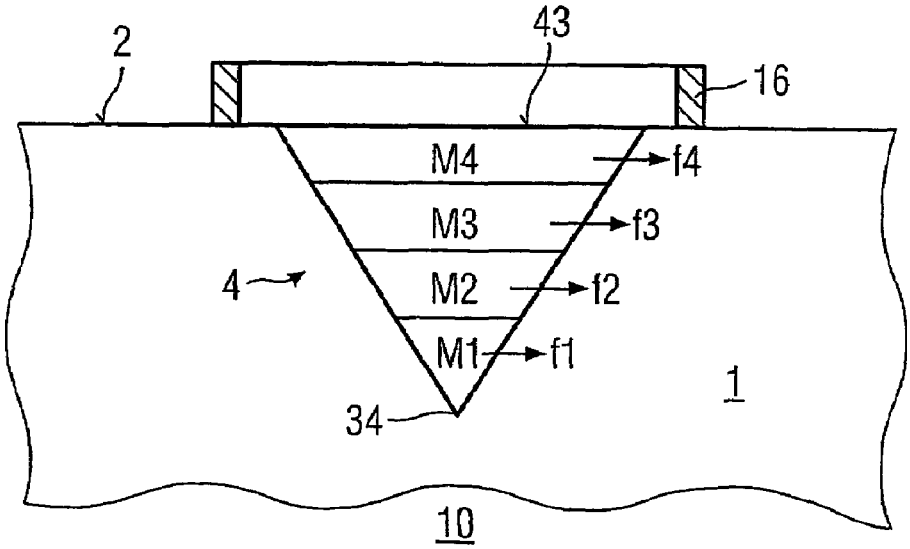
FIG. 2 shows a crack which is filled in steps.

FIG. 2 shows how a first material separation 4 in a substrate 1 can be filled in an improved way.

First of all, a region M1 in the region of the end 34 of the crack is surrounded, by suitable selection of the frequency f1, so that the interaction volume 28 surrounds the region M1 while M1 is being filled.

In a second step, a second region M2 is filled with material, with the frequency f2 being selected in such a way that the interaction volume 28 only extends as far as the region M1 which has previously been filled or if appropriate only partially surrounds it.

Further regions M3, M4, . . . as far as a surface 2 are filled with material by continuously increasing the frequency (f3, f4, . . . ).

Of course, it is also possible for the frequency f to be continuously matched to the remaining depth of the material separation.

Taking account of the altered conductivity in the interaction volume 28, automatic control of the process is possible, since the filling material in the material separation 4 changes the conductivity of the substrate 1 in the interaction volume 28, which is measured and used for control purposes.

Figure 3:
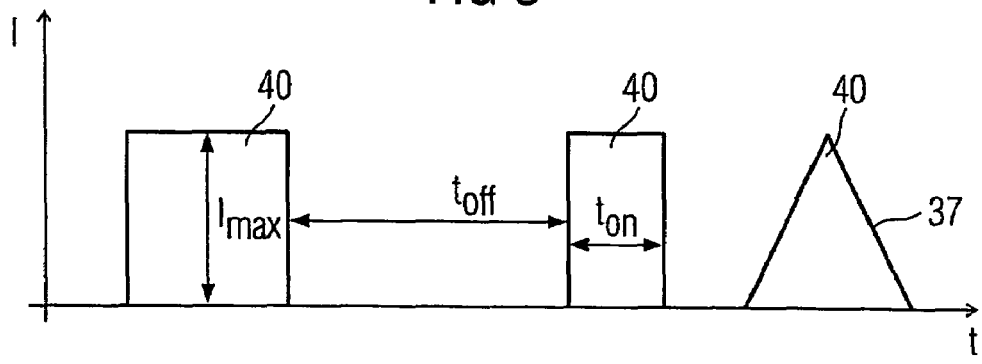
FIG. 3 shows a time profile for a current between substrate and electrode.

FIG. 3 shows a time profile of the current of the voltage source 25. This may be formed from currents which are pulsed or varied over the course of time and can be repeated periodically.

The current is primarily composed of cathode components (substrate 1) and anode components (electrode 7). The pulse duration $t_{on}$, during which a current I is flowing, the interpulse period $t_{off}$ between the pulses 40 and a maximum intensity of the current $I_{max}$ can be varied. It is also possible to alter the shape 37 of the current signal. All the parameters ($I_{max}$, $t_{off}$, $t_{on}$, . . . ) may be a function of time and can be repeated periodically in order to optimize the method.

An alloy (for example NiAl) is deposited by the individual constituents alternately being deposited to an increased extent. By way of example, for each individual alloying constituent Ni, Al there are different optimum parameters ($I_{max}$, $t_{off}$, $t_{on}$, . . . ), which means that, for example, a first current pulse 40 is optimum for the element nickel (ion in the electrolyte 10) and the second, subsequent current pulses 40 are optimum for aluminum. Even during the current pulse which is matched to one element, the other element is still being deposited, albeit to a lesser extent.

The pulses are constantly repeated, so that the constituents of the alloy are optimally mixed.

The proportion by weight of one alloying constituent in the material separation can be set by means of the pulse duration.

Figure 4:
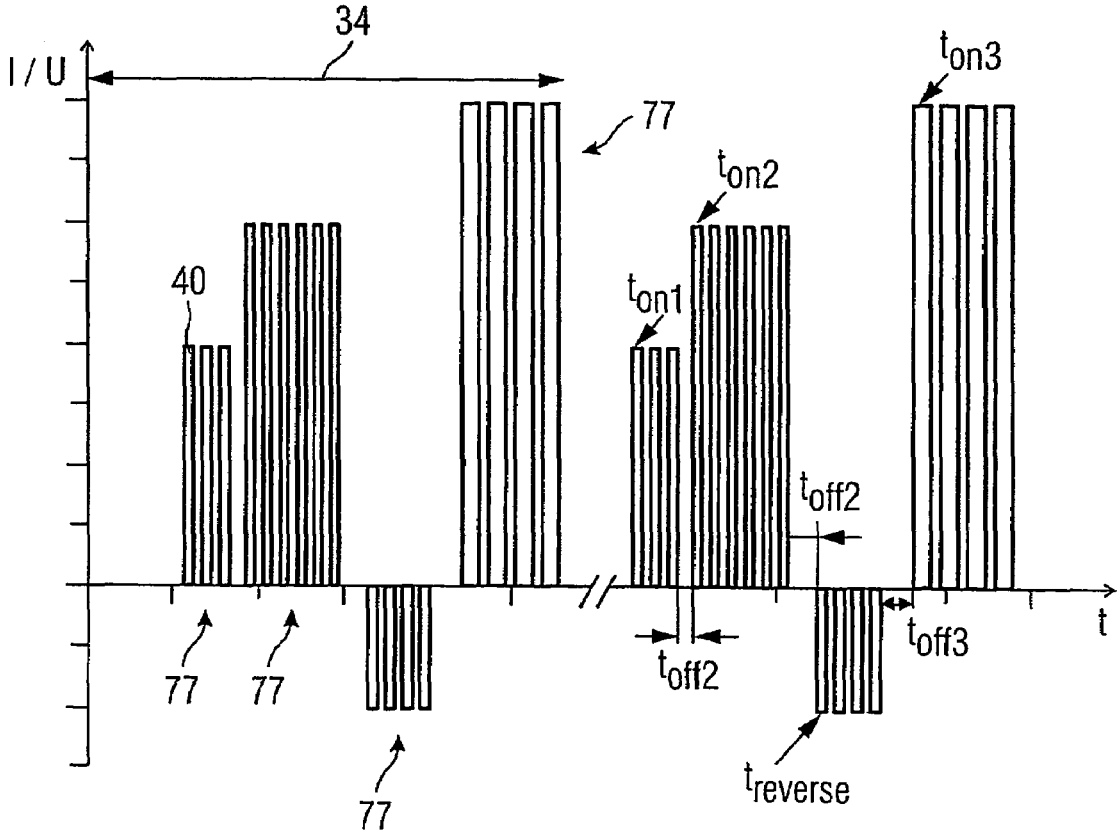
FIG. 4 shows a further time profile for a current between substrate and electrode.

FIG. 4 shows an example of a series of current pulses 40 which are repeated.

A sequence 34 comprises at least two blocks 77. Each block 77 comprises at least one current pulse 40.

A current pulse 40 is characterized by its duration $t_{on}$, the intensity $I_{max\ off}$ and its shape 37 (square-wave, delta-wave, . . . ) .

The interpulse periods between the individual current pulses 40 ($t_{off}$) and the interpulse periods between the blocks 77 are equally important process parameters.

The sequence 34 comprises, for example, a first block 77 of three current pulses 40, between each of which there is an interpulse period. This is followed by a second block 77, which has a higher current intensity and comprises six current pulses 40. This is followed, after a further interpulse period, by four current pulses 40 in the reverse direction, i.e. with a changed polarity.

The sequence 34 is concluded by a further block 77 of four current pulses.

The sequence can be repeated a number of times. The individual pulse times ton are preferably of the order of magnitude of approximately 1 to 10 milliseconds. The total duration of the block 77 is of the order of magnitude of up to 10 seconds, which means that up to 500 pulses are emitted in one block 77.

It is optionally possible to apply a low potential (base current) both during the pulse sequences and during the interpulse periods.

This prevents the electrodeposition from being interrupted, which can cause inhomogeneities.

The parameters of a block 77 are matched to one constituent of an alloy which is to be deposited, for example in order to optimize the deposition of this constituent. These parameters can be determined in individual tests. By way of example, the level of the constituents of the alloy in the layer to be applied can be defined by the duration of the individual blocks 77 in order, for example, to produce gradients in the layer. This is done by correspondingly lengthening or shortening the duration of the block 77 which is optimally matched to one constituent of the alloy.

Figure 5:
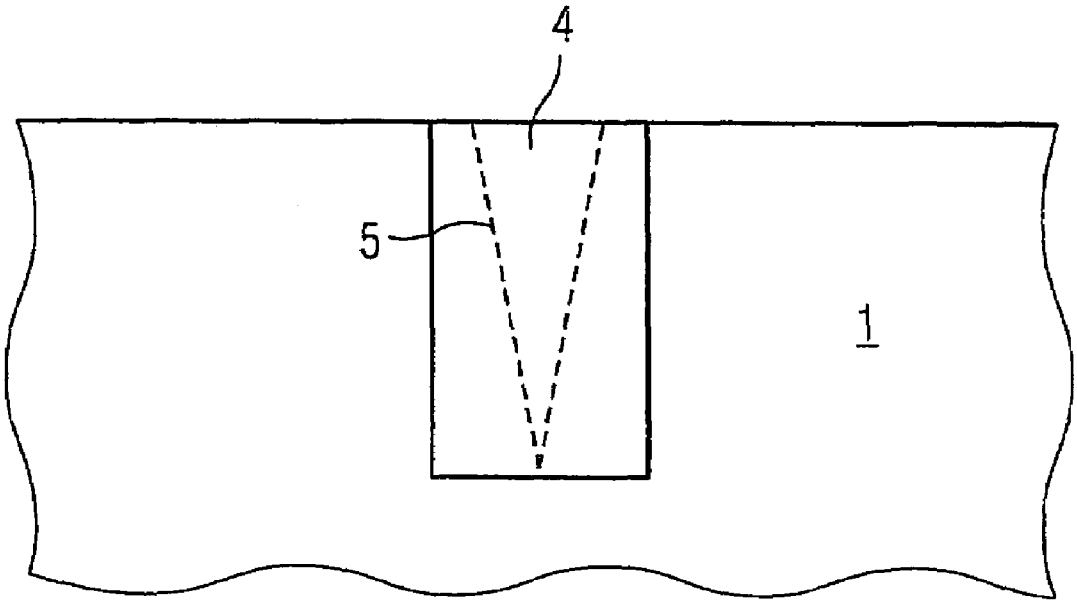
FIG. 5 shows a widened material separation.

FIG. 5 shows a widened material separation 4.

To improve the deposition, the material separation 4 is widened before being filled. This can be done by drilling, EDM or other methods in order, for example, to increase the diameter.

The dashed line shows the material separation 4 prior to the widening.

The invention claimed is:

1. A method for filling a material separation in an opening along a surface of a substrate or a layer, comprising:

filling the material separation in the opening by introducing further material with an electrolytic deposition process while inducing mechanical oscillations in a region of the substrate adjoining the material separation by positioning an eddy-current probe to surround but not cover the opening and to provide an interaction volume extending into the opening about the material separation wherein the frequency of the eddy-current probe is varied during the deposition process so that initially the interaction volume extends a maximum penetration depth into the opening while a portion of the opening at a maximum depth from the surface is filled and, as the opening is filled, the penetration depth of the interaction volume is reduced by increasing the frequency of the eddy-current probe.

2. The method as claimed in claim 1, wherein the substrate or the layer is electrically connected through an electrolyte to an electrode and a variable current is provided between the substrate or the layer and the electrode.

3. The method as claimed in claim 2, wherein the current is pulsed.

4. The method as claimed in claim 3, wherein a base current is superimposed on the current pulses and/or the interpulse periods.

5. The method as claimed in claim 2, wherein the further material is an alloy comprising at least first and second constituents and the current is varied in a repetitive manner so that deposition conditions are alternately more optimum for the first constituent and then more optimum for the second constituent in order to facilitate mixing constituents of the alloy.

6. The method as claimed in claim 2, wherein at least one ultrasound probe is operated in the electrolyte.

7. The method as claimed in claim 2, wherein the further material includes material of a same type as the material of the substrate or the layer.

8. The method as claimed in claim 2, wherein the further material is the same as the material of the substrate or the layer.

9. The method as claimed in claim 1, wherein the material separation is widened in a first method step.

10. The method as claimed in claim 1, wherein a current/voltage pulse is used for the electrolytic deposition, with both positive and negative current/voltage pulses being used.

11. The method as claimed in claim 1, wherein a plurality of repeated current/voltage pulses are combined in a sequence and used for the electrolytic deposition, the sequence of at least two different blocks being used, with a block comprising at least one current pulse.

12. The method as claimed in claim 11, wherein a block is determined by a number of current pulses, pulse duration, interpulse period, current intensity, and pulse shape.

13. The method as claimed in claim 11, characterized in that a block is in each case matched to a constituent of an alloy, in order to boost the deposition of this constituent of the alloy.

14. The method of claim 13 wherein the varying of current in a repetitive manner includes providing current pulses of varied duration and magnitude.

15. The method of claim 14 wherein a base current is superimposed on the current pulses and during periods between pulses.

16. The method as claimed in claim 11, wherein gradients are produced in the material composition within the material separation.

17. The method as claimed in claim 1, wherein the further material includes constituents of an alloy of the type MCrAlY resulting in deposition of the alloy wherein M is an element selected from the group consisting of iron, cobalt and nickel.

* * * * *